United States Patent [19]

Hunter

[11] 4,237,669

[45] Dec. 9, 1980

[54] SEAM ELIMINATOR FOR BUTT JOINTS

[76] Inventor: George S. Hunter, 125 Bennett Rd., Granby, Mass. 01033

[21] Appl. No.: 67,920

[22] Filed: Aug. 20, 1979

[51] Int. Cl.[3] ..... E04B 2/00

[52] U.S. Cl. ..... 52/417; 52/317; 52/364; 52/696

[58] Field of Search ..... 52/416, 417, 418, 317, 52/364, 696; 248/343

[56] References Cited

U.S. PATENT DOCUMENTS

| | | | |
|---|---|---|---|
| 1,742,045 | 12/1929 | Menes | 52/696 |
| 1,867,449 | 7/1932 | Ecket | 52/317 |
| 2,064,785 | 12/1936 | Crandell | 52/417 |
| 3,334,461 | 8/1967 | York | 52/317 |
| 3,675,383 | 7/1972 | Paoletti | 52/417 |

FOREIGN PATENT DOCUMENTS

| | | | |
|---|---|---|---|
| 1287947 | 2/1962 | France | 52/417 |

*Primary Examiner*—James A. Leppink

*Assistant Examiner*—H. E. Raduazo

*Attorney, Agent, or Firm*—Leonard S. Michelman

[57] ABSTRACT

This invention is concerned with a device for eliminating seams at the butt joints caused by the installation of contiguous wall boards in building construction.

A bracket, having means for fastening to the studs, has a slightly recessed surface. The butting edges of the wall boards that are fastened to the studs are screwed down tightly on the recessed surface of the bracket. The wall boards, being somewhat flexible, form a concave outer surface slightly below the plane of the wallboard surface that is mounted on the stud. The concave area is taped and then filled with a selected filling material or a joint compound, bringing the new surface formed thereby back to the original plane of the wallboard. The bracket is permanently secured by the wallboard so there will be no movements, and the filling and taping procedure completely conceal the joint lines, so that the wallboard can be painted or wallpapered and will appear as one continuous surface.

10 Claims, 4 Drawing Figures

SEAM ELIMINATOR FOR BUTT JOINTS

This invention is concerned with a device for eliminating seams which are formed when two contiguous sheets of wallboard are installed in building construction to form the finished walls of various rooms.

Most sheets of dry wallboard are manufactured in dimensions of 4'×12'. When the wallboard is installed on the studs, usually 2"×4", there is a vertical seam, and this appears as a vertical line, even if the finish of the wallboard is painted or covered with wallpaper. Attempts have been made to overcome this problem by taping or plaster filling, or both, but the tape and/or the filler remains as an eye sore.

It is an object to provide a bracket that permits the butt joints of the wall board to be in contact at positions away from the studs.

It is another object of the within invention to provide a device for causing contiguous wallboards to be compressed at the seams, and permitting the use of a tape covered by a joint compound so that the line of the seam is caused to disappear and the eye sore is eliminated.

It is still another object of this invention to provide a bracket that is adaptable to be used with studs that are uniformly spaced apart.

It is yet another object of this invention to provide a bracket that permits the wallboard to be secured into a locked position so that once the seam has been taped and filled, the wallboard can not move and cause the reappearance of the seam.

The bracket herein, adds support to the studs and the wallboard and strengthens the construction of the building, to withstand winds, earthquakes and the like.

Further, the device herein is so designed that it can be shipped and packaged in bulk because each bracket is designed to nest within the other.

These and other objects of the invention are more readily understood by reference to the following detailed description and to the drawings in which.

Figure 4:
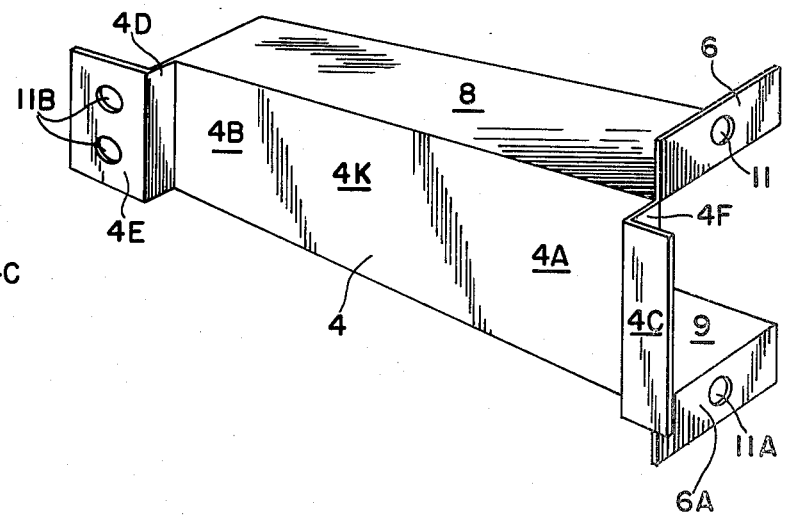
FIG. 4 is a perspective view of the seam eliminator.

Sheets of plaster board 1 form a butt joint or seam at 3. The studs 2 and 2A form the conventional support for the plaster board 1. Studs 2 and 2A are usually 2"×4". The studs 2 and 2A are spaced apart a predetermined distance, usually 16" or 24" on center. The bracket or seam eliminator 4 of FIG. 4 is designed so that the dimension between the surfaces 4D and 4F is approximately a dimension slightly less than the usual distance between the studs 2A and 2. Flange 4E is sufficiently long to make up the distance if the studs are 2"3" further apart. This makes the dimensions of the bracket adaptable to framing variances.

Figure 1:
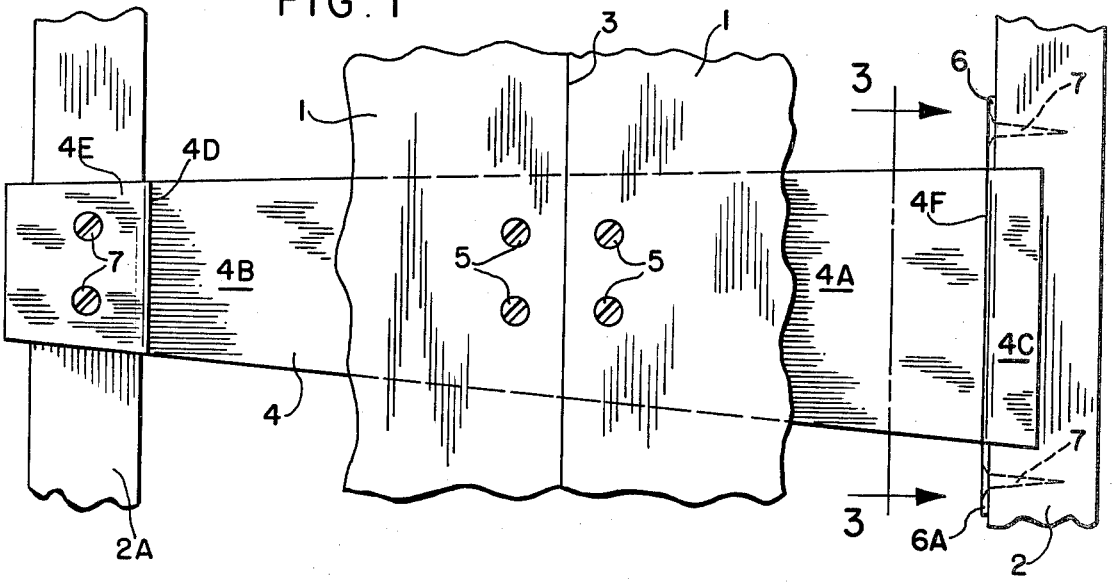
FIG. 1 is a front elevational view of the seam eliminator.

The seam eliminator 4 has a front flat surface 4K consisting of the narrow area at 4B and the wide area at 4A. Its top and lower edges converge as shown in FIG. 1. It has a top flat surface at 8. A vertical flange section 6 extends upwardly from top surface 8 above the wide portion 4A. Extending outwardly from 4A below flange 6 at right angles to 4A is the Section 4F. Bent at right angles to Section 4F and extending outwardly from 4A and parallel to 4A is flange 4C.

At the bottom of surface 4K and extending at right angles thereto is the bottom surface 9. Surface 9 is below surface 8. Extending downwardly and at a right angle to surface 9 is the flange 6A. Flanges 6 and 6A are in the same plane.

At the other end of the surface 4K at the narrow area 4B, there is a vertical Section 4D. A flange 4E extends at right angles to Section 4D. Flange 4E is in the same plane as flange 4C. The length of 4E permits versatility in the use of the bracket 4 where the studs 2 and 2A are further apart than the conventional distance.

The surfaces 4A, 8, 9 and flanges 6, 6A, 4C and 4E as well as the sections 4D and 4F are formed from a sheet metal material that is cut and bent into the shape of the bracket 4 shown in the view of FIG. 4.

In the surface 4E there are shown in FIG. 4 two circular openings which indicate the location to receive the screws 7.

Since 4E is used as an adjustment for the distance between studs these openings are not cut until installation. There is a circular opening 11 in flange 6 as well as opening 11A in flange 6A that are also designed to receive the screws 7. The screws 7 are designed to be used with wood or metal studs.

The bracket 4 is secured to the 2"×4" studs by placing the flange 4E and the flange 4C on the surface of the studs 2A and 2 respectively. See FIG. 1. The screws 7 are inserted and turned at the area of the openings 11 into the stud 2A fastening flange 4E into secured surface contact with the stud 2A. The flanges 6 and 6A are fastened to the inside surface of stud 2 in a similar manner by the screws 7 in the area of the openings 11 and 11A in the flanges 6 and 6A, respectively.

Figure 2:
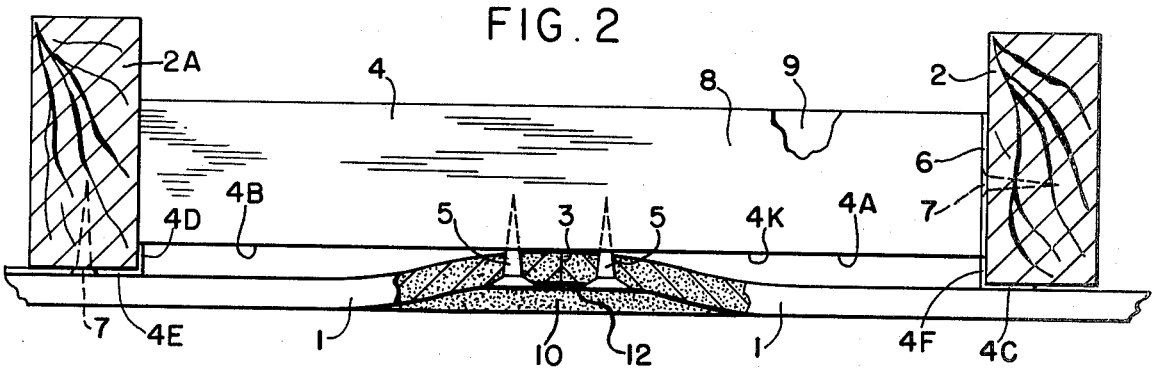
FIG. 2 is a top view looking down on the view of FIG. 1.
Figure 3:
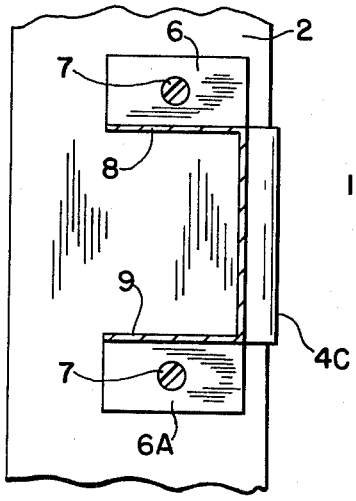
FIG. 3 is a view in section taken along line 3—3 of FIG. 1.

The plaster or wallboard 1 is then fastened to the studs 2 and 2A in the conventional manner. The seam at 3 is now ready to be eliminated. Dry wall screws 5 are inserted through the board 1 as shown in FIG. 2. The boards 1 are bent into surface contact with the surface 4K of the bracket 4 by the pressure of the dry wall screws 5. The dimensions in FIG. 2 are exaggerated so as to teach the concept of this invention. The seam 3 and screws 5 are covered with tape 12. A filler material 10, a compound, is placed and filled over the newly formed concave area caused by the tight fastening of the screws 5. The compound material 10 is leveled at the plane of the wallboard as shown. The seam 3 has now been eliminated. The dimensions of Sections 4D and 4F are less than ¼ inch between the surface of 4C and 4K so that the wallboards 1, when they are screwed down to the surface 4K (4A and B) at any location thereon, will form a concave surface less than ¼ inch from the plane of the face of the wallboards 1 on the studs 2 and 2A, and will permit the use of tape 12 and a filler 10 to conceal screws 5 or butt joint 3 and the seam. It is suggested that along the butt joint at least four brackets be used for a 4 foot width of wallboard on a ceiling joint, spaced apart 16" apart. On a wall joint, three brackets 4 are recommended at a distance of 16" along the butt joints.

Since the studs are either 16" on center or 24" on center apart depending upon the type of construction, bracket 4 is made in two different sizes whereby the length of surface 4K will be either 13" or 19".

The Figures of the drawings show an embodiment that snugly fits between the studs 2 and 2A. If the studs 2 and 2A are further apart, the section 4D will not be in contact with the stud 2A, and there will be a space between 4D and stud 2A. This will not alter the function of the bracket 4, but the purpose is to make bracket 4 useable with the varying dimensions between the studs 2 and 2A, said varying dimensions being from 13" to 18", and 19" to 28", respectively. The screw openings in the areas of 11B will be in a different position when the studs 2 and 2A are further apart. It is not contemplated that the openings 11B will be cut into flange 4E until installation.

I claim:

1. A device for eliminating seams between the butt joints of two contiguous sheets of installed wall board mounted on studs comprising, a front flat surface, a top surface extending at right angles to the rear of said front surface, a bottom surface at right angles to said front surface, below said top surface, said top and bottom surfaces converging towards each other, a first vertical section located at the closest point between said upper and lower surfaces and extending at right angles forward of said front surface, a first flange extending at right angles to said first vertical section and in the same plane as the front surface, a second vertical section extending forward of said front surface and parallel to said first vertical section, a second flange extending outwardly therefrom, and being in the same plane as the first flange, a third section extending upwardly from said top surface and in the same plane as said second section, a fourth section extending downwardly from said bottom surface and in the same plane as said second and third sections.

2. A device as described in claim 1 wherein the dimension of the first and second sections are approximately one-fourth of an inch forward of the front surface.

3. A device as described in claim 2 wherein when two contiguous wall boards are screwed down into surface contact with the front surface, butt joints form a concave surface below the surface of the wall boards that are in contact with the front surfaces of the first and second flanges.

4. A device as described in claims 3 whereby when the butt joint is taped and a filler material is placed over the tape in contact with the front surface and brought up to the level of the plane of the wall boards that rest on the said flanges, the seams caused by the butt joint is eliminated.

5. A device as described in claim 2 having means for securing the contiguous wall boards to the front surface, tape means for covering the seam created by the butt joints of said wall boards, and filler means for bringing the plane of the wall boards at the butt joints up to the level of the plane of the wall boards that are in surface contact with the said flanges.

6. A device as described in claim 2 having means for securing the first flange to the front surface of a stud, and means for securing the third and fourth sections of said device to the inside surface of the next proximate stud.

7. A device as described in claim 6 having means for securing the contiguous wall boards to the front surface, tape means for covering the seam created by the butt joints of said wall boards and means for bringing the plane of the wall boards at the butt joints up to the plane of the wall board that is in surface contact with the said flanges.

8. A device as described in claim 5 having means for securing the first flange to the front surface of a stud, and means for securing the third and fourth sections of said device to the inside surface of the next proximate stud.

9. A device as described in claim 8 wherein when two contiguous wall boards are screwed down into surface contact with the front surface, their butt joints form a concave surface below the surface of the wall boards that are in contact with the front surfaces of the first and second flanges.

10. A device as described in claim 8 whereby when the butt joint is taped and a filler material is placed over the tape in contact with the front surface and brought up to the level of the plane of the wall boards that rest on the said flanges, the seam caused by the butt joint is eliminated.

* * * * *